US005353758A

United States Patent [19]

Masuda et al.

[11] Patent Number: 5,353,758

[45] Date of Patent: Oct. 11, 1994

[54] WIRING ARRANGEMENT FOR OUTBOARD MOTOR

[75] Inventors: Tatsuya Masuda; Kazuhiro Nakamura, both of Hamamatsu, Japan

[73] Assignee: Sanshin Kogyo Kabushiki Kaisha, Hamamatsu, Japan

[21] Appl. No.: 901,428

[22] Filed: Jun. 19, 1992

[30] Foreign Application Priority Data

Jun. 21, 1991 [JP] Japan ..... 3-175903

[51] Int. Cl.[5] ..... F02P 7/00

[52] U.S. Cl. ..... 123/143 C; 123/195 HC

[58] Field of Search ..... 123/143 C, 149 R, 149 D, 123/169 PA, 169 PH, 195 E, 195 HC, 195 P, 647; 440/77

[56] References Cited

U.S. PATENT DOCUMENTS

| | | | |
|---|---|---|---|
| 1,424,056 | 7/1922 | Winblad | 123/143 C |
| 2,048,890 | 7/1936 | Rabezzana | 123/647 |
| 2,213,478 | 9/1940 | Swanson | 123/143 C |
| 3,395,684 | 8/1968 | Minks | 123/647 |
| 3,556,069 | 1/1971 | Minks | 123/647 X |
| 4,155,340 | 5/1979 | Fernquist et al. | 123/647 X |
| 4,933,809 | 6/1990 | Boede et al. | 440/77 X |

*Primary Examiner*—Tony M. Argenbright

*Attorney, Agent, or Firm*—Knobbe, Martens, Olson & Bear

[57] ABSTRACT

A wiring arrangement for an outboard motor including a circular wire harness body fitted within a casing that is secured to the upper portion of the engine of the outboard motor. The wire harness body has sets of branch wires that extend outwardly and which may also extend through slots formed in the side wall of the casing for coupled connection with branch leads that extend to various electrical components of the engine. The branch wire connectors may alternatively be formed integrally with the slots in the casing at which point the branch leads may be connected. Another embodiment provides tube-like extensions which extend outwardly from the slots to protect the branch wires. The branch leads and the coupled connections may also be contained within the tube-like extensions for protection.

20 Claims, 5 Drawing Sheets

WIRING ARRANGEMENT FOR OUTBOARD MOTOR

BACKGROUND OF THE INVENTION

This invention relates to a wiring arrangement for an outboard motor, and more particularly to an improved wiring arrangement that includes a wire harness body positioned in proximity to an upper portion of the engine and having branch wires which extend outwardly for connection with various electronic components of the engine.

It has been the practice with outboard motors to provide a wiring arrangement wherein the main wire harness runs along the interior of the bottom portion of the cowling which surrounds the engine of the outboard motor. Along that length of the wire harness, various wires branch off for connection to individual electrical components associated with the engine.

Although this type of wiring arrangement is generally satisfactory, it has certain disadvantages associated with it. For example, because the main wire harness extends in part along the cowling portion, there is a distinct possibility that it may become immersed in water particularly in adverse weather conditions. This may result in corrosion of the wire harness and possible electrical failure of the system. Being positioned below the engine, the main wire harness is also more likely to come into contact with water which has been sprayed upwardly and has entered the interior of the cowling during operation even under normal conditions. This may also cause problems.

It is, therefore, a principal object of this invention to provide an improved wiring arrangement for an outboard motor that includes a wire harness positioned so as to greatly reduce the possibility that it will come into contact with water.

It is another object of this invention to provide an improved and simplified wiring arrangement for an outboard motor which includes a wire harness assembly that is easily accessible for maintenance purposes.

It is a further object of this invention to provide an improved wiring arrangement for an outboard motor that includes a wire harness having a main body and a plurality of branch wires extending from the main body to individual electrical components, wherein the branch wires are protected and held in place away from the moving parts of the engine.

It is yet another object of this invention to provide an improved wiring arrangement for an outboard motor including a wire harness having branch wires extending from a main body of the wire harness and having standardized connections which can be employed on a variety of different outboard motors.

SUMMARY OF THE INVENTION

This invention is adapted to be embodied in a wire harness assembly for an outboard motor having an engine and a plurality of electrical components. The wire harness assembly comprises a wire harness having a body portion mounted on an upper portion of the engine, and a plurality of branch wires attached to the body portion which extend outwardly for connection with the electrical components.

The wire harness assembly may also include a casing having a cover and a plurality of slots formed therein for the branch wires. The body portion of the wire harness is housed within the casing which, in turn, is positioned on the upper portion of the engine.

Another embodiment of the invention provides a wire harness assembly for an outboard motor having an engine comprising a casing having a cover and a plurality of slots formed therein. The casing positioned on an upper portion of the engine. The wire harness assembly includes a wire harness having a body portion fitted within the casing, and a plurality of branch wires attached to the body portion of the wire harness and extending outwardly. Each branch wire has a connector at the outer end thereof which is formed integrally with one of the slots.

BRIEF DESCRIPTION OF THE DRAWINGS

FIG. 4(*b*) also illustrates a portion of the wire harness body positioned within a groove of the casing.

DETAILED DESCRIPTION OF THE PREFERRED EMBODIMENTS OF THE INVENTION

Figure 1:
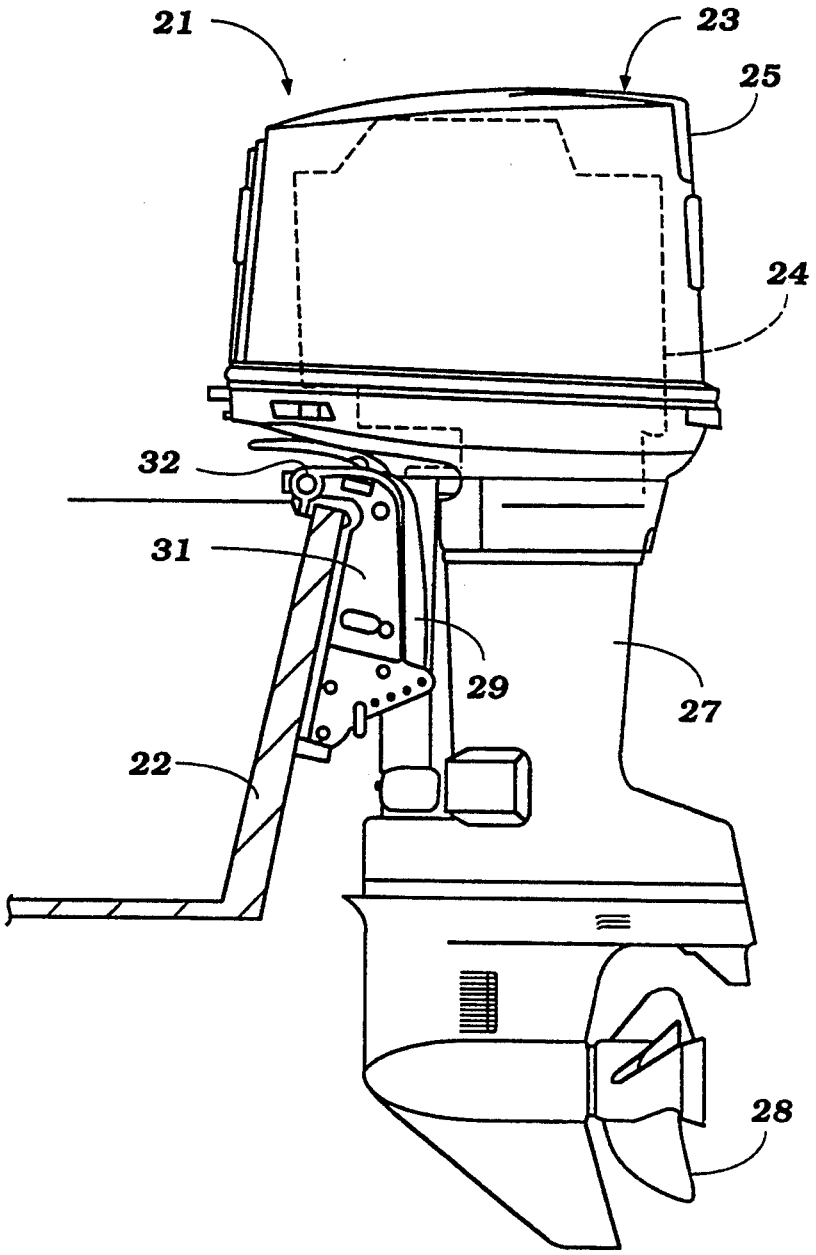
FIG. 1 is a side elevational view of an outboard motor, shown attached to the transom of an associated watercraft, illustrating the environment in which the invention may be practiced.

Referring first to FIG. 1 of the drawings, an outboard drive unit in the form of an outboard motor constructed in accordance with embodiments of the invention is identified generally by the reference numeral 21. The outboard motor 21 is mounted on a transom 22 of a hull of an associated watercraft. The outboard motor 21 is comprised of a power head 23 which includes an internal combustion engine 24 which is, in the illustrated embodiment, of the V-6, spark ignited, four cycle type. It is to be understood, however, that the invention can also be utilized in conjunction with engines of a different type or different configuration. The engine 24 is surrounded by a protective cowling 25 to complete the power head 23.

The engine 24 has an output shaft 26 (see FIG. 3) that drives a driveshaft journaled for rotation within a driveshaft housing 27. The driveshaft, in turn, drives a propeller 28 of a lower unit through a conventional forward, neutral, reverse transmission of any known type.

A steering shaft is affixed to the driveshaft housing 27 and is journaled within a swivel bracket 29 for steering of the outboard motor 21 about a generally vertically extending steering axis. The swivel bracket 29 is, in turn, connected for pivotal movement to a clamp bracket 31 by means of a pivot pin 32 for tilt and trim adjustment of the outboard motor 21. A clamping mechanism is carried by the clamp bracket 31 for affixing the outboard motor 21 to the transom 22 of the associated watercraft.

The construction of the outboard motor 21 as thus far described may be considered conventional and since the invention deals with the engine 24 and the wiring for its associated electrical components, further description of the outboard motor 21 is not believed to be necessary to understand the construction and operation of the invention.

Referring now to FIGS. 2 through 6, the engine 24, which is vertically disposed in the illustrated embodiments, is comprised of a cylinder block 33 which is provided with angularly disposed cylinder banks, each of which has a cylinder head 34 attached to it in a known manner. A valve cover 35 is attached to each cylinder head 34 for enclosing the cylinder valves.

The engine is also provided with an induction system that includes an air inlet device that draws air in from the interior of the cowling 25 and delivers the air to a plurality of carburetors (not shown) through an intake manifold 36 and silencer 37. The carburetors supply a mixture of fuel and air to the engine 24 and specifically to the individual crank chambers formed in the crankcase 38 wherein the crankshaft 26 is journaled for rotation. Reed type check valves in a spacer plate 39 which is interposed between the carburetors and the cylinder block 33 prevent reverse flow through the manifold passages as is well known in this art.

In addition to the carburetor charge forming system, the engine 24 is also provided with a fuel injection system. This fuel injection system includes a pair of injector rails 41, one associated with each cylinder head 34 and mounted in proximity to it. The injector rails 41 have air and fuel passage lines for delivering a fuel and air mixture to the cylinders through injector nozzles in circuit with the injector rails 41 is an injector relay 42 which cooperates in controlling the injection process.

Spark plugs are provided for the cylinders of the engine 24 and are mounted in the cylinder heads 34 in a known manner. The spark plugs are fired by means of individual ignition coils 43, one associated with each spark plug, which are charged and triggered by means of an electronic ignition control device that includes a capacitor discharge ignition (CDI) unit and which is indicated by the reference numeral 44. The CDI unit includes means for controlling the ignition timing and the firing of the spark plugs.

The firing power for the spark plugs is derived from a magneto generator assembly which is driven by the engine 24 and which includes a rotor 45 that is affixed to the upper end of the crankshaft 26 by means of a nut and key. A flywheel 46 is affixed on the outer periphery of the rotor 45, and below the flywheel 46 is a drive pulley 47 formed on the lower portion of the rotor 45 for the timing belt.

The engine 24 is also provided with an electric starter motor 48 that is in circuit with a battery 51. The starter 48 is mounted on the engine 24 and has a starter gear with teeth that are enmeshed with the teeth of a corresponding ring gear formed on the flywheel 46 for starting the engine 24 via a starter relay 49.

In accordance with the invention, the outboard motor 21 is provided with a wire harness assembly identified generally by the reference numeral 52. The wire harness assembly 52 includes a casing 53 and a removable top cover 54 for enclosing the casing 53. The casing 53 has a plurality of attachment sections 55 with apertures formed therethrough that are adapted to be aligned with corresponding apertures in boss sections 56 formed on the cylinder block 33 and crankcase 38 when the casing 53 is appropriately positioned on the boss sections 56 overlying the rotor 45. The top cover 54 also has a plurality of attachment sections 57 with apertures formed therethrough which are in register with a corresponding attachment section aperture of the casing 53 and with a corresponding boss section aperture when the top cover 54 is appropriately positioned on the casing 53. The top cover 54 and the casing 53 are then secured together by means of bolts 58, each of which extends through a corresponding cover aperture, casing aperture and boss section aperture.

Figure 2:
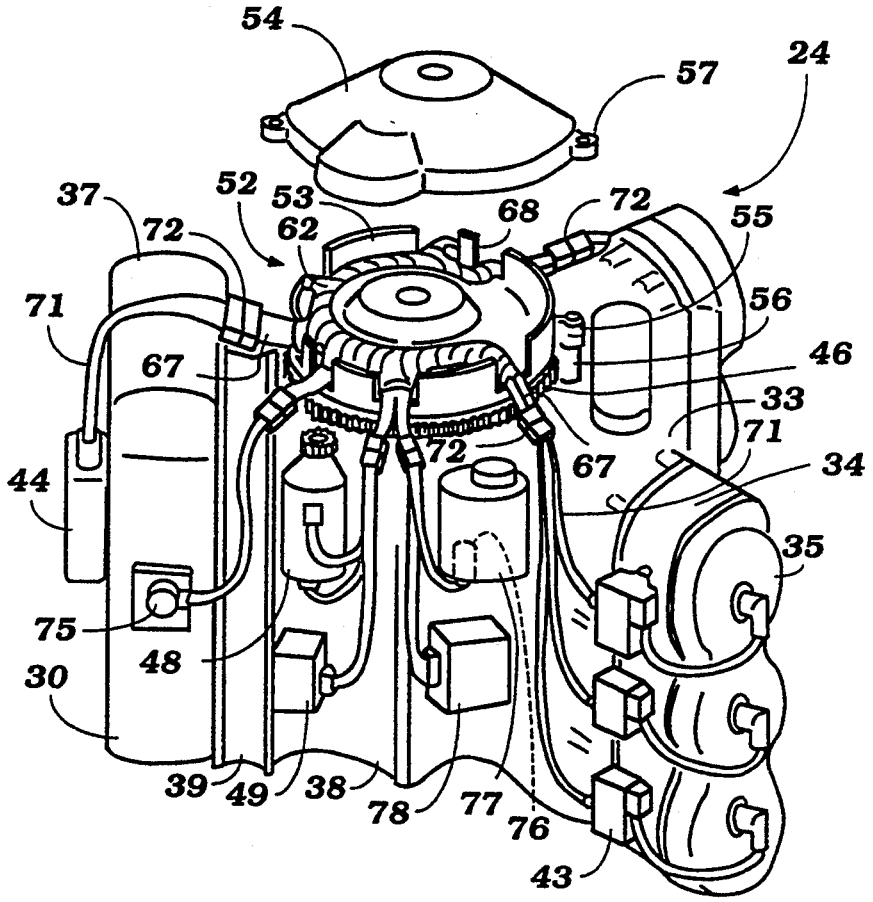
FIG. 2 is a perspective view of the engine of the outboard motor with a wire harness assembly constructed and arranged in accordance with a first embodiment of the invention.
Figure 3:
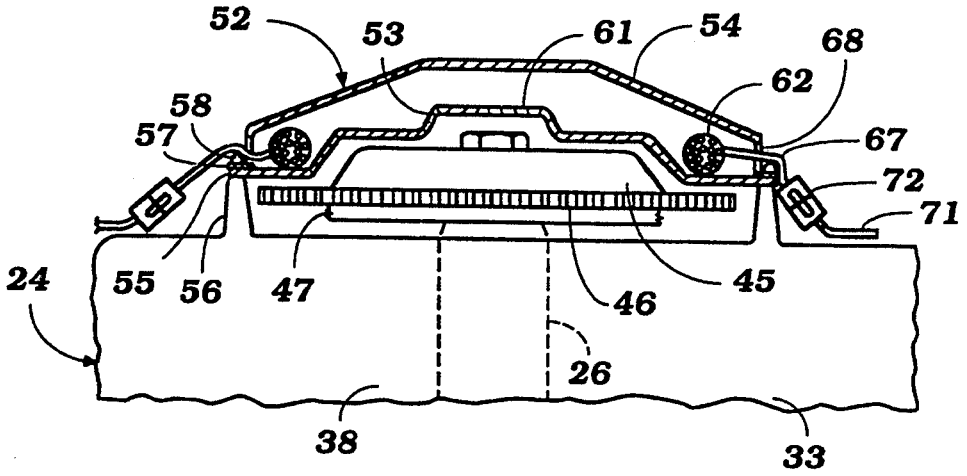
FIG. 3 is a side elevational view of the upper portion of the engine, with parts shown in cross section, showing the positioning of the wire harness body in accordance with a first embodiment of the invention.

As seen in FIGS. 2 and 3, the casing 53 has a raised center portion 61 which overlies the rotor 45 and a circumferential groove around the raised center portion 61 in which a circular body portion of a wire harness 62 is supported. This body portion may be fastened to the inside of the casing 53 by means of a bonding agent.

Figure 4:
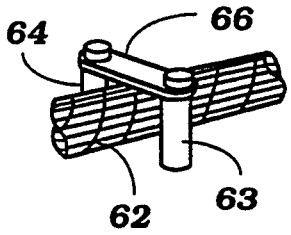
FIG. 4(*a*) shows a portion of the wire harness body along with two of a plurality of bosses which together cooperate to maintain the wire harness body within a casing of the wire harness assembly.
Figure 4:
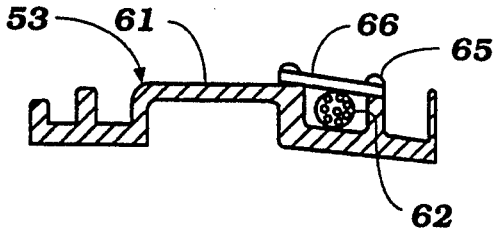

The circular body portion of the wire harness 62 may be held in place within the interior of the casing 53 between two sets of bosses as shown in FIG. 4(*a*). One set has bosses 63 at spaced locations along a circular path on the base of the casing 53 while the other set has corresponding bosses 64 spaced outwardly from the bosses of the first set 63 and erected on the base of the casing 53 along a circular path which is concentric with, but of a greater diameter, than the circular path of the first set 63.

Alternatively, as shown in FIG. 4(*b*), the circular body portion of the wire harness 62 may be held within the circumferential groove formed in casing 53 by means of a set of bosses at spaced locations around the outer periphery of the raised center portion 61 and another set of corresponding bosses 65 that are spaced outwardly from the bosses of the first set. The sets of bosses each define a circle concentric with, but of a different diameter than that of, the other circle.

In either case, a restraining plate 66 bridges the upper sections of corresponding bosses, one from each set, for maintaining the circular body portion of the wire harness 62 in place.

Figure 5:
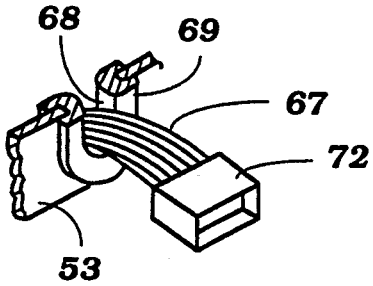
FIG. 5 illustrates the construction of the slots in the casing through which the branch wires of the wire harness assembly extend in the first embodiment.

A plurality of sets of branch wires 67 extend outwardly from the body portion of the wire harness 62 through slots 68 formed at spaced locations in the outer circumferential wall of the casing 53. As shown in FIG. 5, each of these slots 68 is fitted with a grommet 69 to protect the branch wires 67 from damage or breaking as a result of movements of the casing 53 or the wires 67 themselves.

Each set of branch wires 67 terminates in a connector which is adapted to be connected to a corresponding connector of a branch lead or leads 71 which interconnect the corresponding branch wire set 67 with a particular electrical component. Each branch wire set connector and its corresponding branch lead connector form a coupler identified by the reference numeral 72.

Figure 6:
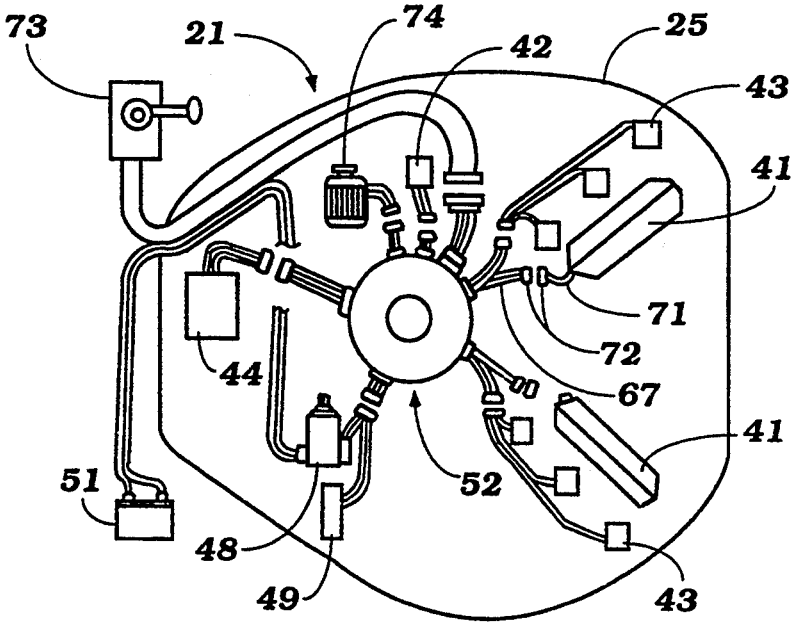
FIG. 6 is a top view of the engine of the outboard motor illustrating the wire harness assembly and interconnected electrical components.

As shown in FIGS. 2 and 6, the branch leads 71 extend to a number of different electrical engine components such as a remote control operator 73 positioned in front of the driver's seat of the associated watercraft and the battery 51 positioned externally of the cowling 25. In the interior of the cowling 25 and interconnected to the wire harness 62 by way of one of the various branch leads 71 is a generator 74, the ignition coil and control device 43 and 44, the starter motor and relay 48 and 49, the injector rails and relay 41 and 42, a throttle sensor 75, a level sensor 76 inside the engine's oil tank 77, an oil pump (not shown), and a fuse box 78.

The base of the casing 53 is also formed with water drainage holes. Also, it should be noted that the body portion of the wire harness 62 may comprise a printed circuit board, in which case cooling holes are also formed in the base of the casing 53 to dissipate heat generated by the board. Further cooling of the board may be effected by affixing a cooling fin on the upper surface of the flywheel 46 to channel air.

Figure 7:
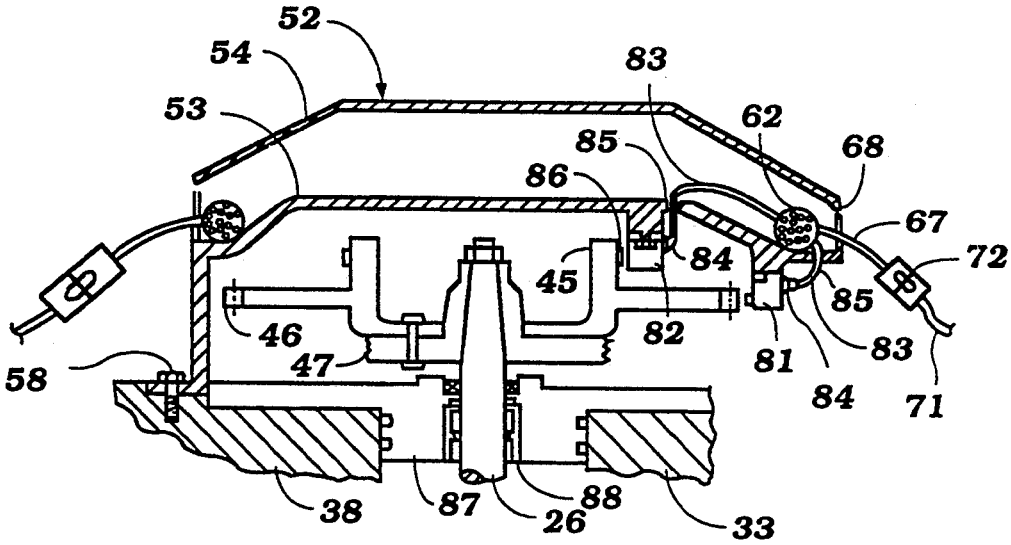
FIG. 7 is a side elevational view of the upper portion of the engine, with parts shown in cross section showing the positioning of the wire harness body constructed in accordance with a second embodiment of the invention.

A second embodiment of the invention is illustrated in FIG. 7. In this embodiment, the rotor 45 is placed upside down and a crank angle sensor 81 and a pulser coil 82 are affixed to the underside of the base of the casing 53. Individual connecting wires 83 are connected to these components 81 and 82 by means of couplings 84 and extend through respective openings 85 formed in the base of the casing 53 to the wire harness body. The pulser coil 82 detects the reference angle position of the crankshaft 26 through a protruding section 86 formed on the rotor 45. The crank angle sensor 81 detects the crank angle position of the crankshaft 26 by detecting the rotational position of the flywheel gear 46.

Also, in the second embodiment, the casing 53 is formed with an outer wall which is fastened to the cylinder block 33 and crankcase 38 by the bolts 45 just outside of a bearing housing 87 of the crankshaft 26 so as to make it possible to control the angular error allowance about the crankshaft 26. The bearing housing 87 is fitted in a space formed between adjoining surfaces of the cylinder block 33 and crankcase 38 and supports the crankshaft 26 by means of a bearing 88.

It will also be noted that the cover 54 in this second embodiment is secured only to the casing 53 and not directly to the engine 24.

Figure 8:
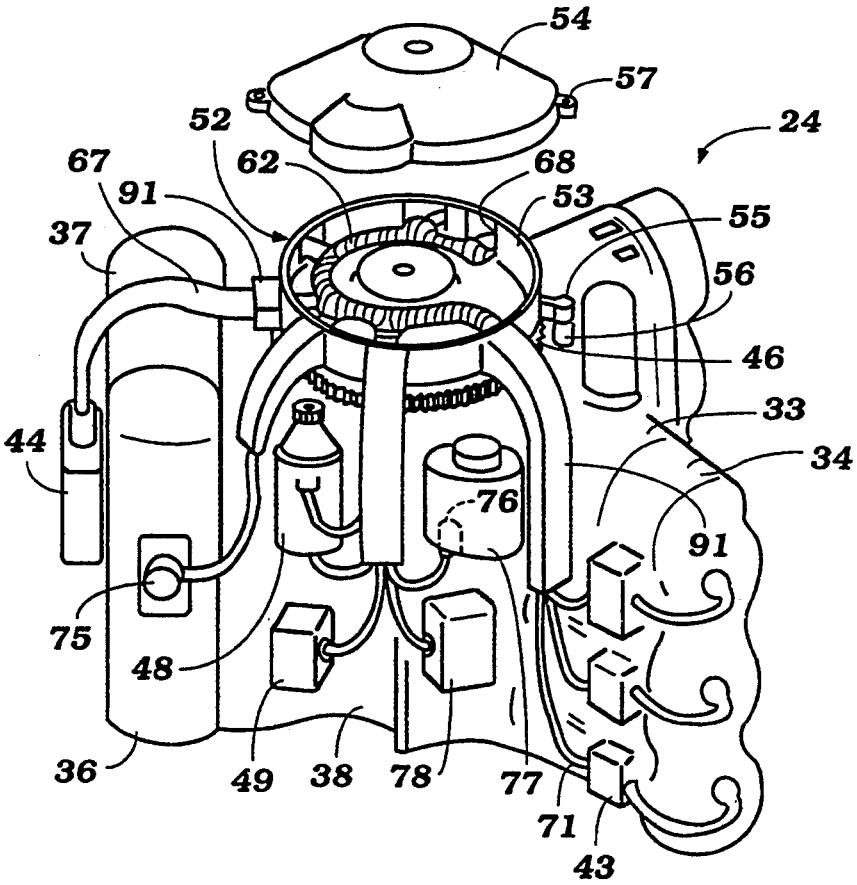
FIG. 8 is a perspective view of the engine illustrating the wire harness assembly constructed in accordance with a third embodiment of the invention.
Figure 9:
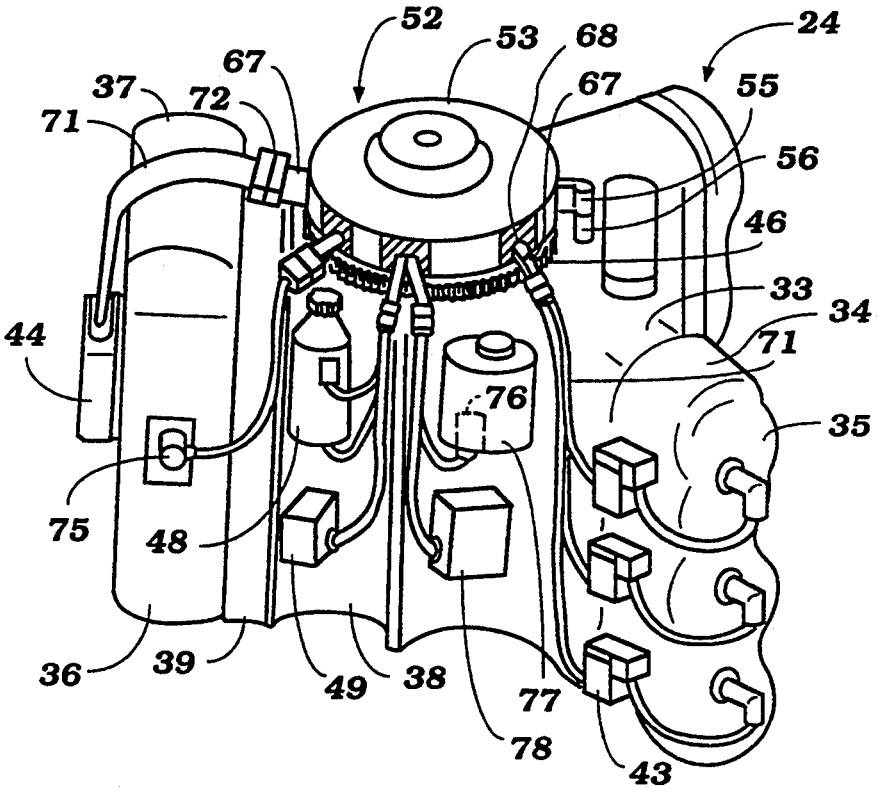
FIG. 9 is a perspective view of the engine and wire harness assembly in accordance with a fourth embodiment of the invention.
Figure 10:
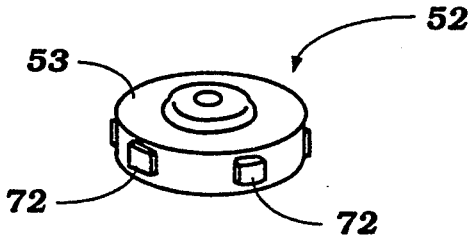
FIG. 10 illustrates the casing of the wire harness assembly wherein connectors for the branch wires are positioned in the slots of the casing.

FIGS. 8, 9 and 10 illustrate wire harness assemblies for an outboard motor constructed in accordance with third and fourth embodiments of the invention. The construction of the engine 24 and wire harness assembly 42 in these third and fourth embodiments is generally similar to that described in connection with the first embodiment. For that reason, components of these third and fourth embodiments which are the same as components of the first embodiment are identified by the same reference numerals and will not be described again, except insofar as is necessary to understand the construction and operation of these third and fourth embodiments.

The third embodiment of the invention, shown in FIG. 8, differs from the first embodiment in that the third embodiment has tube-shaped extensions 91 extending outwardly and downwardly from the slots 68 formed in the outer wall of the casing 53. The branch wires 67, couplers 72 and branch leads 71 may be located within the tube-shaped extensions 91 depending on their length to provide additional protection for these components and prevent them from interfering with other engine components.

The construction of the tube-shaped extensions 91 may also be such that they run to the bottom surface of the cowling 25 where they are secured for supporting the casing 53. If this is done, it may be done in addition to or instead of securing the casing 53 and cover 54 to the block 33 and crankcase 38 as previously described.

In the fourth embodiment of the invention, illustrated in FIGS. 9 and 10, the wire harness body is molded within the casing 53. The molding can be done with or without the wires bundled. The branch wires 67 and their connectors may extend out of the slots 68 in the casing 53 or, alternatively, the connectors may be formed integrally with the slots 68 as shown in FIG. 10.

It should be readily apparent from the foregoing description that an improved wiring arrangement for an outboard motor has been illustrated and described. A circular wire harness body is positioned in a casing secured to the upper portion of the engine to reduce the possibility that it will come into contact with water and also to make it easily accessible for maintenance purposes. Branch conductors extend outwardly through slots in the side wall of the casing for connection with various electronic components of the engine. Although several embodiments of the invention have been illustrated and described, various changes and modifications may be made without departing from the spirit and scope of the invention, as defined by the appended claims.

We claim:

1. A wire harness assembly for an outboard motor having an engine disposed with an output shaft rotatable about a vertically disposed axis and a plurality of electrical components comprising a wire harness having a body portion mounted on an upper portion of the engine at a position above an upper end of said output shaft, and a plurality of branch wires attached to the body portion of said wire harness and extending outwardly for connection with said electrical components.

2. A wire harness assembly as recited in claim 1, further comprising a casing having a cover and a plurality of slots formed therein, said casing being positioned on the upper portion of the engine and wherein the body portion of said wire harness is housed within said casing and wherein said plurality of branch wires extend outwardly through the slots.

3. A wire harness assembly as recited in claim 2, wherein each of the slots is formed with a grommet.

4. A wire harness assembly as recited in claim 1, wherein said engine is a V-type engine.

5. A wire harness assembly for an outboard motor having an engine and a plurality of electrical components comprising a wire harness having a body portion mounted on an upper portion of the engine and a plurality of branch wires attached to the body portion of said wire harness and extending outwardly for connection with said electrical components, and a casing having a cover and a plurality of slots formed therein, said casing being positioned on the upper portion of the engine and wherein the body portion of said wire harness is housed within said casing and wherein said plurality of branch wires extend outwardly through the slots, said engine comprising a cylinder block, an output shaft having upper and lower ends and a flywheel affixed to the upper end of said output shaft, said casing being secured to the cylinder block and positioned above said flywheel.

6. A wire harness assembly for an outboard motor having an engine and a plurality of electrical components comprising a wire harness having a body portion mounted on an upper portion of the engine, a plurality of branch wires attached to the body portion of said wire harness and extending outwardly for connection with said electrical components, and a casing having a cover and a plurality of slots formed therein, said casing being positioned on the upper portion of the engine and wherein the body portion of said wire harness is housed within said casing and wherein said plurality of branch wires extend outwardly through the slots, wherein said casing has a raised center portion and a circumferential groove around the raised center portion, and wherein the body of said wire harness is positioned in the circumferential groove.

7. A wire harness assembly for an outboard motor having an engine and a plurality of electrical components comprising a wire harness having a body portion mounted on an upper portion of the engine and a plurality of branch wires attached to the body portion of said wire harness and extending outwardly for connection with said electrical components, and a casing having a cover and a plurality of slots formed therein, said casing being positioned on the upper portion of the engine and wherein the body portion of said wire harness is housed within said casing and wherein said plurality of branch wires extend outwardly through the slots, said casing having a plurality of paired bosses extending upward from the base of said casing and arranged to define a circumferential section in said casing in which the body of said wire harness is positioned.

8. A wire harness assembly for an outboard motor having an engine and a plurality of electrical components comprising a wire harness having a body portion mounted on an upper portion of the engine and a plurality of branch wires attached to the body portion of said wire harness and extending outwardly for connection with said electrical components, and a casing having a cover and a plurality of slots formed therein, said casing being positioned on the upper portion of the engine and wherein the body portion of said wire harness is housed within said casing and wherein said plurality of branch wires extend outwardly through the slots, a crank angle sensor and a pulse coil both affixed to the underside of the base of said casing and both connected to said wire harness by means of respective connecting wires.

9. A wire harness assembly as recited in claim 8, wherein said casing has a pair of openings formed in the base and wherein each of said connecting wires extend through a respective opening.

10. A wire harness assembly for an outboard motor having an engine and a plurality of electrical components comprising a wire harness having a body portion mounted on an upper portion of the engine and a plurality of branch wires attached to the body portion of said wire harness and extending outwardly for connection with said electrical components, and a casing having a cover and a plurality of slots formed therein, said casing being positioned on the upper portion of the engine and wherein the body portion of said wire harness is housed within said casing and wherein said plurality of branch wires extend outwardly through the slots, said engine comprising a cylinder block, a crankcase, an output shaft having upper and lower ends, a bearing housing associated with the output shaft, and a flywheel affixed to the upper end of said output shaft, said casing being secured to the bearing housing and is positioned above the flywheel.

11. A wire harness assembly for an outboard motor having an engine and a plurality of electrical components comprising a wire harness having a body portion mounted on an upper portion of the engine and a plurality of branch wires attached to the body portion of said wire harness and extending outwardly for connection with said electrical components, and a casing having a cover and a plurality of slots formed therein, said casing being positioned on the upper portion of the engine and wherein the body portion of said wire harness is housed within said casing and wherein said plurality of branch wires extend outwardly through the slots, said casing having a plurality of tube-like extensions, one associated with each of the slots and extending outwardly therefrom to accommodate at least a portion of said branch wires.

12. A wire harness assembly for an outboard motor having an engine comprising a casing having a cover and a plurality of slots formed therein, said casing being positioned on an upper portion of the engine, said wire harness assembly further comprising a wire harness having a body portion fitted within said casing, and a plurality of branch wires attached to the body portion of said wire harness and extending outwardly, each wire having a connector at the outer end thereof, each connector being formed integrally with one of said slots.

13. A wire harness assembly as recited in claim 12, wherein the engine comprises a cylinder block, an output shaft having upper and lower ends and a flywheel affixed to the upper end of said output shaft, and wherein said casing is secured to the cylinder block and is positioned above the flywheel.

14. A wire harness assembly as recited in claim 12, wherein said casing has a raised center portion and a circumferential groove around the raised center portion, and wherein the body of said wire harness is positioned in the circumferential groove.

15. A wire harness assembly as recited in claim 12, wherein said casing has a plurality of paired bosses extending upward from the base of said casing and arranged to define a circumferential section in said casing in which the body of said wire harness is positioned.

16. A wire harness assembly as recited in claim 12, wherein each of the slots is formed with a grommet.

17. A wire harness assembly as recited in claim 12, further comprising a crank angle sensor and a pulser coil both affixed to the underside of the base of said casing and both connected to said wire harness by means of respective connecting wires.

18. A wire harness assembly as recited in claim 17, wherein said casing has a pair of openings formed in the base and wherein each of said connecting wires extends through a respective opening.

19. A wire harness assembly as recited in claim 12, wherein the engine comprises a cylinder block, a crankcase, an output shaft having upper and lower ends, a bearing housing associated with the output shaft, and a flywheel affixed to the upper end of said output shaft, and wherein said casing is secured to the bearing housing and is positioned above the flywheel.

20. A wire harness assembly as recited in claim 12, wherein the body portion of said wire harness is molded within said casing.

* * * * *